United States Patent [19]

Brachet et al.

[11] 4,440,099

[45] Apr. 3, 1984

[54] CERAMIC FIBER MODULAR ASSEMBLIES FOR LINING FURNACE WALLS

[75] Inventors: Pierre Brachet, Versailles; Gilbert Leduc, Mennecy, both of France

[73] Assignee: La Farge Refractaires, Aristide-Briand, France

[21] Appl. No.: 374,322

[22] Filed: May 3, 1982

[30] Foreign Application Priority Data

Jun. 12, 1981 [FR] France ..... 81 11675

[51] Int. Cl.[3] ..... F23M 5/00

[52] U.S. Cl. ..... 110/336; 52/506; 52/715; 110/341

[58] Field of Search ..... 110/336, 341; 52/506, 52/712, 715

[56] References Cited

U.S. PATENT DOCUMENTS

| | | | |
|---|---|---|---|
| 2,074,874 | 3/1937 | Vogel | 110/336 |
| 2,120,133 | 6/1938 | Kohler . | |
| 3,819,468 | 6/1974 | Sauder et al. . | |
| 3,832,815 | 9/1974 | Balaz et al. | 52/506 |
| 3,841,195 | 10/1974 | Jureit | 52/715 |
| 4,052,831 | 10/1977 | Roberts et al. | 52/715 |
| 4,344,753 | 8/1982 | Shelley et al. | 110/336 |

FOREIGN PATENT DOCUMENTS

| | | |
|---|---|---|
| 152681 | 5/1968 | France . |
| 232101 | 3/1977 | France . |
| 238429 | 11/1978 | France . |

*Primary Examiner*—Edward G. Favors
*Assistant Examiner*—Steven E. Warner
*Attorney, Agent, or Firm*—Frost & Jacobs

[57] ABSTRACT

A ceramic fiber modular assembly for lining walls of furnaces is disclosed. The modular assembly comprises stacked strips of ceramic fibers and a refractory steel anchoring system. The anchoring system comprises two platelike lateral member which protrude parallel to the ceramic fiber strips with teeth projecting from both sides by the lateral members. One of the lateral member is rigidly fixed to a platelike central member and the other admits of translation relative thereto. An aperture in the central member permits securement to the wall of the furnace. During manufacture the modular assembly is partially wrapped in packaging material tied with straps, applying compression to the fibers. The packaging material is removed prior to installation of the modular assembly. When installed tight fitting contiguous modular assemblies exert compression on the fibers.

19 Claims, 8 Drawing Figures

CERAMIC FIBER MODULAR ASSEMBLIES FOR LINING FURNACE WALLS

BACKGROUND OF THE INVENTION

The invention relates to the field of ceramic materials, and more particularly to such materials in the form of ceramic fiber mats. The invention relates especially to ceramic fiber modular assemblies for lining the walls of furnaces and other high temperature chambers.

It is already known to use ceramic fiber mats for insulating the walls of furnaces and other high temperature chambers. In some embodiments the mats have been applied flatwise along the walls; by superposing a number of mats the desired degree of heat insulation may be attained. In other embodiments the ceramic fiber mats or strips are disposed perpendicular to the walls to be lined. In such techniques it has also been proposed to make modular assemblies of generally parallelepipedic configuration which, on assembly, are disposed side by side on the walls to be lined. Each of the assemblies is held on a wall by a metal anchoring system, generally of refractory steel.

The ceramic fiber mats, strips or modular assemblies are subjected to severe mechanical and thermal stresses in use in the furnaces or other high temperature chambers. Arrangements known up to now have not always given satisfaction. The lining of walls with ceramic fiber has not been sufficiently reliable and expedient.

OBJECT AND SUMMARY OF THE INVENTION

An object of the invention is to overcome the drawbacks of the prior art by providing a ceramic fiber modular assembly which may be factory manufactured and readily installed for lining the wall of a furnace or other high temperature chamber, and by providing thermal insulation in which the ceramic fibers are disposed in a continuous, uniform manner.

In accordance with the invention there is provided a ceramic fiber modular assembly for lining the walls of furnaces or other high temperature chambers of the type comprising stacked fiber strips in generally parallelepipedic configuration and a refractory steel anchoring system for holding the strips and securing the assembly to the walls to be lined. According to the invention, the novel anchoring system comprises at least two parallel lateral members engaged in one face of the assembly, each one of said lateral members defining a plate oriented parallel to the fiber strips and attached to the interior of the assembly by protrusions. The anchoring system further comprises a central member disposed perpendicular to the lateral members and cooperating therewith, the central member also defining a plate bearing flatwise against said face of the assembly and having an aperture for securement of the modular assembly to the wall to be lined. The anchoring system holds the ceramic fiber strips modular assembly, also referred to as the module, to the wall of the furnace. According to the invention the anchoring system is specially designed according to the structure of the module which is made of stacked strips and not a mat of fibers forming zigzags.

DISCUSSION OF THE PRIOR ART

By way of example in the field of the invention Sauder U.S. Pat. No. 3,819,468 may be cited which discloses the general procedure of lining the wall with ceramic fiber modules. The strips making up the modules are stacked against one another and disposed perpendicular to the wall of the furnace. The anchoring system disclosed in the Sauder patent comprises sheet metal angle members on the eges of the module. Wires extend transversely through the stack of strips and are attached to the angle members.

As prior art reference French Pat. 76,24,259 (publication No. 2 321,101) in the name of Thorpe may be cited. This patent also concerns a ceramic fiber lining of modular design. It is essential to note that in the Thorpe module the insulating mat is of precise configuration, being folded to form a number of folds. As shown in the Thorpe patent the fiber mats have a generally zigzag configuration which is entirely different fom that of the invention which comprises a stack of individual strips. The resulting anchoring structures are therefore different. In Thorpe the anchoring system comprises a central bar attached to two sloping members which are sunk into the mat. These members are wirelike and have no compression or holding function for the fiber strips. They simply function to hold the module when the latter is attached by the central bar to a wall of the furnace, the fiber strips, owing to the very structure of the mat, then being held against one another.

On the contrary, in the present invention the fibers are distributed in the individual stacked strips. This arrangement is advantageous from the functional viewpoint, for in the elevated temperature conditions the modules are subjected to, the fibers shrink and in addition the ceramic material reaches a degree of crystallization which causes it to lose its natural elasticity entirely. This phenomenon is less marked for a module comprised of individual stacked strips, when the anchoring system provided for securing it to the wall also has a compression effect on the strips. In the present invention the lateral members are defined by plates. They penetrate deep into the module and they are attached in the strips by their protrusions such as teeth or pins. These various means permit the lateral members from not only holding the individual strips of the module but also compressing them against one another. This teaching is in no respect found in the Thrope patent.

By way of example of the state of the art Babcock French Pat. No. 1,523,681 may be also cited. This patent relates to a lining for vaulted ceilings of furnaces. It should be observed that this lining is made of refractory bricks, that is a material of a nature and having properties extremely different from those of ceramic fibers. The lining technique using refractory bricks is very old whereas lining with ceramic fibers is much more recent. It is clear that the technical problems to be overcome with ceramic fiber linings are not the same. The Babcock patent proposes the insertion of plates between rows of bricks and the plates are suspended directly from the vaulted ceiling of the furnace. It will be noted that this arrangement is moreover limited to lining vaulted ceilings or arches and therefore is not suitable for vertical walls. The upper parts of the plates extend beyond the bricks and are provided with holes for attaching the suspension elements. The plates may be provided with attachment pins or teeth in the bricks.

In the present invention the anchoring system comprises a central member and two lateral members defined by plates. In the Babcock patent there is only a series of plates arranged side by side and used directly for suspension after putting a hook in place. In the latter case the hooking is effected on the plate.

Further, by the very nature of the refractory material Babcock teaches a rigid construction. Babcock is not concerned with compression of the individual strips as in the present invention. Babcock does not teach the advantageous possibility of sliding at least one of the lateral members relative to the central member as in the case of the present invention.

Isomax French patent No. 78,10,981 (publication No. 2,387,429) further illustrates the state of the art, but does not disclose any metal anchoring system comparable to that of the present invention. In addition the Isomax patent does no teach a modular design lining. According to the invention, the metal anchoring system is designed to hold and secure each module. Isomax teaches that because, the mounting, the fiber strip are held against one another by friction. According to the invention, the strips in each module are held by lateral members defined by plates.

U.S. Pat. No. 2,120,133 relates to a refractory brick lining. Intermediate metal members are arranged between the bricks to which they are attached by teeth. The assembly is fixed to the wall by tie or attached to the ceiling hanger or suspended by rods. This patent does not teach or suggest the present invention.

OTHER FEATURES OF THE INVENTION

Preferably, each of the lateral members of the anchoring system for the module of the invention is a refractory steel plate in which protrusions such as teeth or pins are formed by stamping and are oriented substantially perpendicular to the plane of the respective lateral member plates. There is advantage in making some protrusions oriented to one side of the plate whereas other protrusions are oriented in the opposite direction. The arrangement of the teeth may be alternating. In an embodiment a lateral member is provided with nine teeth, four outwardly directed teeth in the lower part and the five remaining longer teeth being inwardly directed of the assembly.

Such a construction is merely an example and any other arrangement of teeth or protrusions may be adopted.

The central member joins the two lateral members. It is also made of refractory steel and cooperates with each lateral member. At least one of the ends of the central member is fixed, e.g., by welding, to one of the lateral members. The other end may also be fixed in the same manner to the other lateral member. Yet according to an advantageous embodiment at the other end is provided a connection with a certain degree of leeway permitting the other member to be disposed, in particular by translation, with respect to the central member. This may be simply obtained by inserting the central member in a suitable slot in the other lateral member or by forming a guideway by appropriately configuring the upper part of the other lateral member.

The central member is also defined by a plate and bears flatwise on the one face of modular assembly. It comprises an aperture for mechanical securement of the modular assembly to the wall to be lined. It is advantageous that the central member be provided, in addition, with two ribs or stiffeners disposed on opposite sides of the aperture, which is elongated.

According to a modified embodiment the anchoring system may comprises in addition to the two lateral members and the central member, an intermediate member substantially similar to the lateral members and disposed therebetween for reinforcing the attachment to the fiber mats. The intermediate member may be fixed either rigidly to the central member, e.g. by welding, or with a certain degree of leeway, as described above, for permitting its translation relative to the central member.

The modular assembly therefore essentially comprises stacked ceramic fiber strips and a metal anchoring system. The ceramic fiber strips are precut before assembly, these strips being cut out of ceramic fiber blankets. The width is determined by the desired thickness of the module. The number of strips depends on the desired compression in the ultimate assembly. It is also a function of the density of the ceramic fiber blanket employed and its compressibility. The quality of the ceramic fibers used depends on the temperature of the furnace or the high temperature chamber in which the modular assemblies are to be installed. By way of example rock wool fibers, ceramic fibers and other high temperature resistant fibers may be used.

The one face of the modular assembly on which the lateral members are disposed and against which the central member of the anchoring system bears is adapted to be applied against the wall to be lined—is therefore the cold face. The opposite or hot face has no anchoring system. Where appropriate and if necessary there may be provided on the cold face in order to strengthen the central fibers of the strips, discrete areas such as streaks or dabs of a high temperature resistant adhesive, for example, cement.

The securement of the modular assembly on the sheet metal of the furnace or high temperature chambers is done by any appropriate mechanical means known to those skilled in the art, for example, by threaded stud and nut assemblies.

The fixing of the threaded stud or fastener to the wall is done in any suitable manner, for example, by welding, or even by drilling a hole in the steel work of the wall for external securement.

During manufacture in the factory, the modular assembly is enclosed in cardboard or other packaging material on three sides, leaving the one face with the metal members of the anchoring system exposed. The cardboard is held in place by metal or plastic ties or straps so that a compact modular assembly is obtained when leaving the factory which ensures the mechanical strength of assembly and permits the desired compression to be maintained on the fiber mats.

Before mounting in the furnace or high temperature chamber the metal or plastic ties or straps and the cardboard packaging are removed. The compression imparted to the ceramic fiber strips during manufacture in the factory and that due to mounting is relaxed and the ceramic fiber strips are compressed against adjacent modular assemblies and/or steelwork wall of the furnace or high temperature chamber. In case one of the lateral members or the optional intermediate member is displaceable for translation relative to the central member, they naturally take the position corresponding to the release of pressure on the strips. This embodiment therefore has the advantage of also distributing the pressure in service to all the strips of the module.

With a view to limiting the shrinkage of the ceramic fibers subjected to high temperatures, it is advantageous for the modular assemblies to be disposed in a checkerboard pattern to the extend possible.

For vertical walls all the modular assemblies may be disposed in the same direction or orientation, the ceramic fiber strips making up the modular assemblies all then being arranged vertically. Further, a ceramic fiber sheet having a width equal to the thickness of the modular assembly may be placed between each modular assembly location.

Complementarily, for technical reasons, that is, to avoid the flow of hot gas (i.e. stray gas) between modular assemblies damaging the steel work of the furnace or high temperature chamber, and to avoid the phenomenon known as air wave, a mat of ceramic fibers may advantageously be placed at the back of the modular assembly, against the sheet metal. This mat may, for this purpose, have an initial thickness of about 25 mm and compressed to a thickness between 10 and 15 mm when the module is installed.

In addition it will be noted that to reduce the cost of the installation it will be possible to provide between the wall and the modular assembly one or more layers of rigid or flexible material of lesser quality than that of the modular assemblies.

This invention also enables metal electrical resistors to be secured by arranging between the mats rigid or semirigid support members and support members exceed the width of the modules. They may be provided at the time of fabrication or only when the modular assemblies are installed on the wall to be lined.

It will also be noted that it is possible after installing the modular assemblies to provide each modular assembly with preshrinkage slits. The number of slits will depend on the width of the modular assemblies.

The invention will now be illustrated, without in any way being limited, by the description which follows, with reference to the accompanying drawings.

DESCRIPTION OF THE PREFERRED EMBODIMENTS

Figure 1:
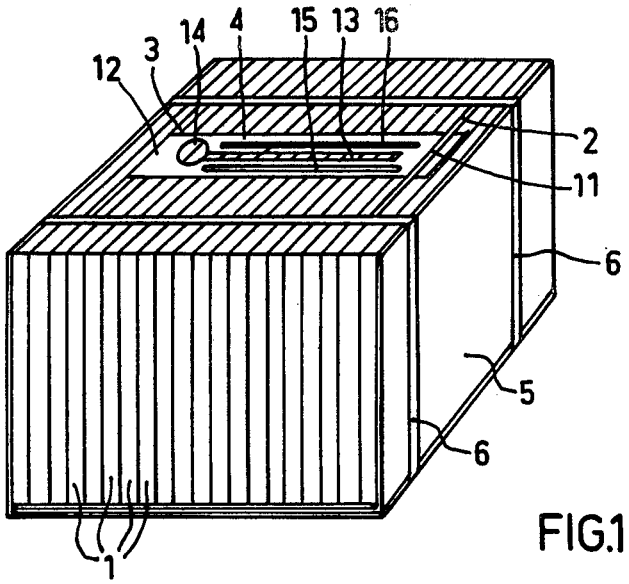
FIG. 1 is a perspective view of a modular assembly prefabricated in accordance with the invention, as it leaves the factory.

As shown in FIG. 1 the modular assembly of the invention is comprised of stacked ceramic fiber strips 1. Also seen in FIG. 1 is the metal anchoring system on the upper face which comprises two identical lateral members 2,3 and a central member 4. The anchoring system will be described in greater detail below with reference to FIGS. 2–5. Modular assemblies of the type illustrated in FIG. 1 may have sections of 300×300 mm or 600×300 mm with variable thicknesses ranging from 100–300 mm. The ceramic fiber strips 1 are precut before asembly, these strips being cut out from 25 mm thick blankets, the length of the strips being 300 or 600 mm, depending on the case, and the width being determined by the desired thickness of the module and may vary accordingly from 100 to 300 mm.

Figure 8:
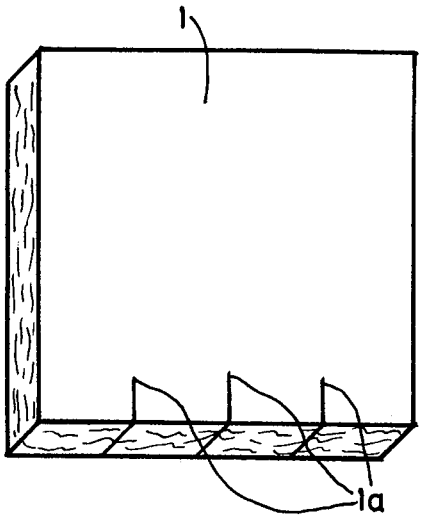
FIG. 8 illustrates slits along the edges of the strips making up a module.

Each strip 1 of the module may advantageously be provided at the time of manufacture of the modular assembly with at least three slits 1*a*, preferably as shown in FIG. 8. These slits have, for example, a width between 0.1 mm and 2 mm and a depth of 20 mm which may run up to 40 mm as a function of the width of the strip.

When it leaves the factory, the modular assembly is as shown in FIG. 1, that is to say, with cardboard packaging 5 which covers three faces, leaving the top face exposed. The cardboard packaging 5 may be in one or more pieces. Two metal straps or ties 6 hold the cardboard packaging 5 and the modular assembly. For installation in a furnace or a high temperature chamber, the straps or ties 6 and the cardboard packaging 5 are removed.

Figure 2:
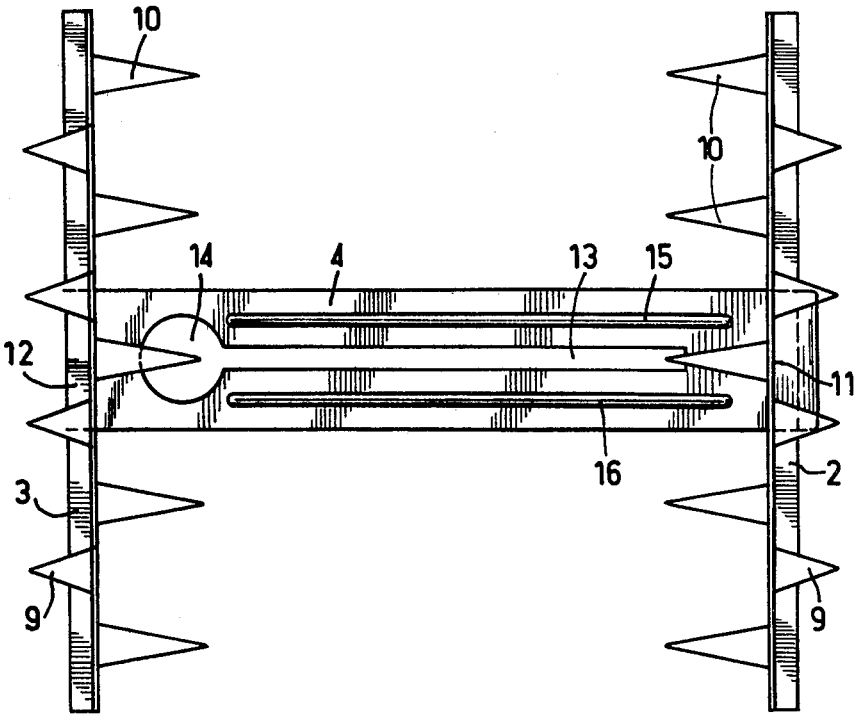
FIG. 2 is a bottom plan view of the anchoring system.
Figure 3:
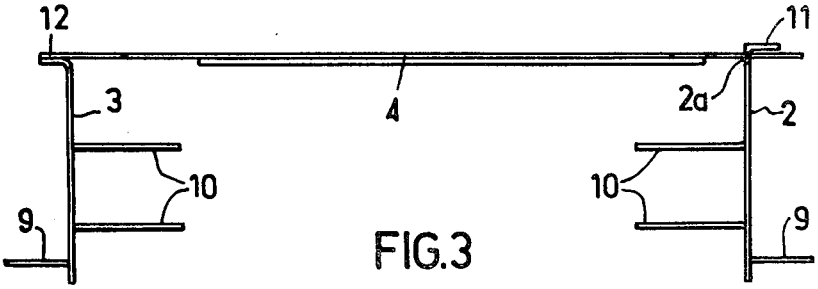
FIG. 3 is a side elevational view of the anchoring system.
Figure 4:
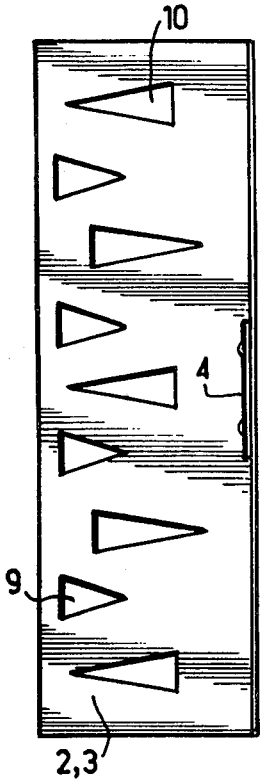
FIG. 4 is a side view of the anchoring system.

As shown in FIGS. 2–5, and noted above, the metal anchoring system comprises two lateral members 2 and 3 and a central member 4. The lateral members 2 and 3 are similar. With modules having the dimensions indicated above, the lateral members 2,3 have a width of 250 mm and a height of 80 mm. They are defined as plates penetrating inside the modular assembly. That is why in FIG. 1 only the upper parts of the lateral members 2 and 3 are seen, which is provided with flanges 7 and 8, bearing flatwise against corresponding faces of the module. The lateral members 2 and 3 are made of refractory steel and have a thickness of 1 mm. Teeth or strikes are formed by stamping and in the illustrated embodiment are nine in number. It will be sufficient to described the teeth of lateral member 2 since those of lateral member 3 are identical. The staggered arrangement of the teeth is clearly visible in FIG. 4. As shown in FIGS. 2 and 3, the teeth are vertically staggered so as to form four teeth in the lower part and five teeth in the intermediate and upper parts. There are four lower teeth 9 and five teeth 10 in the lateral member 2. The lower teeth 9 are outwardly directed from the lateral member 2 and penetrate into the strips of the modular assembly towards the ends thereof so as to pin the end strips. The teeth 10 are longer than teeth 9 and are inwardly directed for pinning the inner strips.

The central member 4 is also made of refractory steel. It has a thickness of 1.5 mm and a width of 80 mm. The ends 11 and 12 thereof cooperate with the lateral numbers 2 and 3 respectively. The central member 4 is defined as a plate which is disposed flatwise on the corresponding face of the modular assembly. The central member 4 has an elongated aperture 13, 170 mm long and 8 mm wide, terminating by a hole 14 for receiving the device for securing the modular assembly to the sheet steelwork of the furnace or high temperature chamber. The central member 4 is moreover provided with two stiffeners 15,16 disposed on opposite sides of the elongated aperture 13.

At least one of the lateral members 2,3 may be fixed rigidly, for example by welding, to the corresponding end of central member 4. In the drawings the preferred embodiment is illustrated in conformity with which the other lateral member, instead of being also rigidly fixed to the central member 4 may be slidable with respect thereto. In the illustrated embodiment the central member 4 extends through a slot in lateral member 2, as shown in FIGS. 1–3 and 5. FIG. 3, in particular, shows the slot 2*a* in lateral member 2 in which the central member 4 is slidable.

Figure 5:
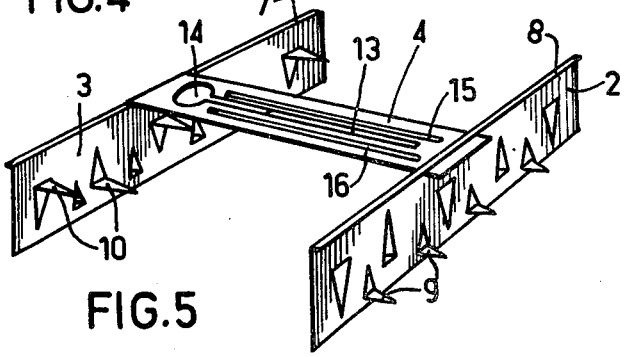
FIG. 5 is a schematic perspective view of the anchoring system.

FIG. 5 is a perspective view illustrating the anchoring system for insertion into the modular assembly as shown in FIG. 1.

Figure 6:
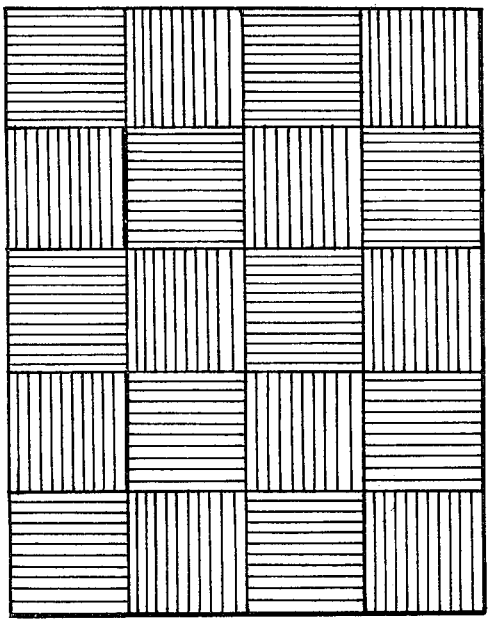
FIG. 6 is a schematic view of the layout of modular assemblies on the wall of a furnace.

FIG. 6 schematically shows the installation of modular assemblies in conformity with the invention for lining a wall of a furnace. The modular assemblies are arranged in a checkerboard pattern with strips 1 of contiguous modular assemblies mutually perpendicular to one another as shown in FIG. 6.

Figure 7:
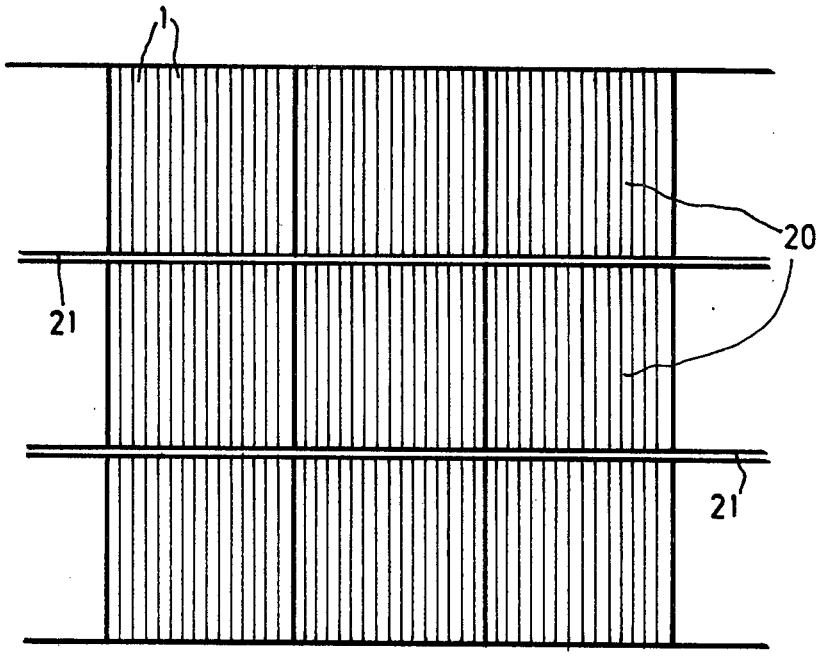
FIG. 7 schematic view of the layout of modular assemblies according to a modified embodiment suited for lining vertical walls.

FIG. 7 illustrates an alternative embodiment suitable for lining vertical walls. In this figure the modular assemblies are all oriented in the same direction, the strips 1 being disposed vertically. Between horizontal rows 20 of modules a ceramic fiber sheet 21 is provided having a width equal to the thickness of the modules and oriented horizontally.

The securement of each modular assembly to the steelwork of a furnace is done by any known means, for example, by a cylindrical washer gripping a threaded stud or fastener provided with a corresponding nut. The threaded stud or fastener is fixed to the steelwork of the furnace by welding. Any other mode of securement may be employed. Such modes of securement have not been shown in the drawings, for they are within the purview of those having ordinary skill in the art and they are not actually part of the invention.

An alternative embodiment has not been illustrated in the accompanying drawings in which between the steelwork of the furnace to line and the modular assemblies according to the invention there is provided a mat in one or more parts intended, notably, to prevent stray gas from the furnace from reaching the wall thereof after infiltrating through the modules. The installation of such an additional met may be effected in any manner known to those skilled in the art.

The foregoing description shows that the invention provides a ceramic fiber modular assembly which may be factory manufactured by ensuring the application of compression on the ceramic fiber strips. Once the packaging and metal straps are removed for installation on the wall of the furnace, the ceramic fiber strips expand and are compressed by adjacent modules and/or the wall of the furnace. It will thus be noted that during installation an additional compression of the fiber mats may be provided.

In a simple manner there is provided heat insulating coverings for walls of furnaces or high temperature chambers which comprise easy-to-install, continuous, uniform lining. It is also advantageous for the modular assemblies to be factory prefabricated.

It goes without saying that the invention is not limited to the embodiment described with reference to the drawings. Alternatives and modifications understood to those skilled in the art may be adopted without departing from the scope of the invention as defined in the appended claims.

What we claim is:

1. In a ceramic fiber modular assembly for lining walls of furnaces or other high temperature chambers, said modular assembly comprising stacked ceramic fiber strips in generally parallelepiped configuration and a refractory steel anchoring system for holding said strips and securing said modular assembly to the wall to be lined, the improvement consisting of providing an anchoring system comprising: at least two lateral members engaged in a face of said modular assembly, each of said lateral members defining a plate oriented parallel to said fiber strips and including perpendicular protrusions attached to the interior of said modular assembly by perpendicularly projecting into said strips adjacent said lateral members; a central member disposed perpendicular to said lateral members and attached therewith, said central member also defining a plate bearing flatwise against said one face of said modular assembly having an aperture for securement to the wall to be lined wherein said protrusions project parallel to said central member.

2. The modular assembly of claim 1, wherein each of said lateral member plates is made of refractory steel and said protrusions project substantially perpendicular to the planes of said lateral member plates.

3. The modular assembly of claim 2, wherein said protrusions project from both sides of each of said lateral members plates.

4. The modular assembly of claim 1, wherein said central member is fixed at each end to said lateral member.

5. The modular assembly of claim 1, wherein one of the ends of said central member is fixed to one of said lateral members, the other end of said central member assembled with means permitting a degree of leeway with one other lateral member permitting relative translatory displacement between said other lateral member and said central member.

6. The modular assembly of claim 5, wherein said means includes a slot formed in said other lateral member said central member engaged in said slot in said other lateral member.

7. The modular assembly of claim 5, wherein said means includes a guideway formed in said other lateral member said central member engaged in said guideway formed in said other lateral member.

8. The modular assembly of claim 1, wherein said aperture in said central member plate includes mechanical means for securing said assembly to the wall to be lined.

9. The modular assembly of claim 7, wherein said central member comprises stiffeners disposed on opposite sides of said aperture which is elongated.

10. the modular assembly of claim 1, wherein said anchoring system further comprises an intermediate member substantially similar to said lateral members and disposed therebetween, said intermediate member being rigidly fixed to said central member.

11. The modular assembly of claim 1, wherein said anchoring system further comprises a intermediate member substantially similar to said lateral members and disposed therebetween, said intermediate member being assembled with means permitting a degree of leeway with said central member for permitting relative translatory displacement between said intermediate member and said central member.

12. The modular assembly of claim 1, wherein said one face of said modular system which is intended to be the cold face thereof comprises discrete areas of high temperature resistant adhesive.

13. The modular assembly of claim 1, further comprising packaging material enclosing part of said modular assembly and exposing said one face.

14. The modular assembly of claim 13, wherein said packaging material temporarily maintains the fibers in said stacked strips under compression.

15. A method for installing modular assemblies for lining steelwork walls of a furnace or other high temperature chamber, in which each said modular assembly comprises stacked ceramic fibers strips in generally parallelepiped configuration and a refractory steel anchoring system for holding said strips and securing said modular assembly to the wall to be lined, said anchoring system of said modular assembly comprising two lateral members engaged in one face of said modular assembly, each of said lateral members defining a plate oriented parallel to said fiber strips and including perpendicular protrusions attached to the interior of said modular assembly by perpendicularly projecting into said strips adjacent said lateral members, a central member disposed perpendicular to said lateral members and attached therewith, said central member defining a plate bearing flatwise against said one face of said modular assembly and having an aperature for securement to the wall to be lined, packaging material partially wrapping said modular assembly, exposing said one face thereof and temporarily maintaining said fibers of said strips under compression; wherein said method comprises the steps of: removing said packaging material and thereby reducing pressure applied to said fibers of said modular assembly, and then securing said modular assembly to said steelwork wall in tight fitting relation with adjacent modular assemblies and against said steelwork wall thereby compressing said fibers in said modular assembly.

16. The method of claim 15, including arranging said modular assemblies in a checkerboard pattern on said steelwork frame, with the fiber strips of contiguous modular assemblies mutually perpendicular to one another.

17. The method of claim 15, including arranging said modular assemblies in generally horizontal rows with their strips generally vertically oriented, parallel to one another along the vertical walls of said furnace or other high temperature chamber.

18. The method of claim 17, further comprising providing sheets of ceramic fibers between said horizontal rows of modular assemblies, the width of said sheets equal to the thickness of said modular assemblies.

19. The method of claim 15, further comprising attaching an additional layer between said steelwork wall and said modular assemblies before securement of the latter.

* * * * *